United States Patent [19]

Rupp et al.

[11] 4,143,183

[45] Mar. 6, 1979

[54] METHOD OF DECORATING GLASSWARE

[75] Inventors: Thomas F. Rupp, Sylvania; Lowell J. Wells, Toledo, both of Ohio

[73] Assignee: Owens-Illinois, Inc., Toledo, Ohio

[21] Appl. No.: 809,951

[22] Filed: Jun. 27, 1977

[51] Int. Cl.[2] ..... B05D 5/00; B41F 17/08; B05C 17/04; G03C 7/00

[52] U.S. Cl. ..... 427/266; 428/36; 96/34; 101/40; 101/123; 427/269

[58] Field of Search ..... 101/40, 115, 124, 126, 101/123; 156/237; 427/266, 269, 259; 96/30, 31, 34; 428/36

[56] References Cited

U.S. PATENT DOCUMENTS

| | | | |
|---|---|---|---|
| 2,892,734 | 6/1959 | Hoffman | 427/266 X |
| 3,673,954 | 7/1972 | Lala | 101/40 |
| 3,948,171 | 4/1976 | O'Connell | 101/40 X |

FOREIGN PATENT DOCUMENTS

| | | | |
|---|---|---|---|
| 1342108 | 12/1973 | United Kingdom | 427/266 |

*Primary Examiner*—George F. Lesmes
*Assistant Examiner*—Daniel R. Zirter
*Attorney, Agent, or Firm*—David R. Birchall; Myron E. Click; David H. Wilson

[57] ABSTRACT

The method and decorated article comprising glassware such as bottles and drinking tumblers is set forth. Halftone printing of a plurality of different colors is employed to produce a composite graphic display on the surface of the glass. Precise alignment is utilized in order to register the halftone printing screens for each color that is deposited on the glass surface. The opaque enamels employed in the decorative process are carefully balanced with respect to each other to obtain the desired color hues. The deposition angles for the alignment of the halftone dots is controlled to minimize the undesirable moire effect.

6 Claims, 1 Drawing Figure

METHOD OF DECORATING GLASSWARE

BACKGROUND OF THE INVENTION

The prior art, such as for example U.S. Pat. No. 3,673,954, reveals that it has been common practice to apply decorations of one type or another to the exterior of glass containers such as for example bottles and drinking tumblers. The containers are decorated by the well known silk screen process wherein a moving array of containers is moved toward the decoration station by means of a conveyor. The containers are then positioned in a holding jig or fixture. The container is then printed while being subjected to rotation about its axis of symmetry. The actual printing is achieved by means of a silk screen that carries thereon the design that is to be imparted to the exterior sidewall of the container.

One or more colors have been applied to the exterior of a glass container. Such decoration has in the past necessitated a release of the container from the holding fixture and a transfer back to the conveyor where the container is moved to another decoration station. Thus, in the past, the application of four or five colors required the same number of printing stations and also the same number of container handling operations.

Also, it is well known to utilize the silk screen technique for reproducing color photographs on flat surfaces. Such photographic reproduction has been quite acceptable, particularly when organic inks have been used.

The use of organic, as well as inorganic coloring pigments, have been silk screened onto the exterior of glass containers, however, such decorations generally rely upon a composition where the colors actually overlay each other or are positioned adjacent each other.

The prior art also sets forth another decorative process known as halftone printing. In this process the various colors within a color original are separated and halftone positives are then made. In order to create a full complement of colors and hues, at least three halftone positives are necessary; each one representing one of the primary colors, such as for example magenta, cyan and yellow. The halftone positives are then placed on a silk screen to create images on the silk screen. By subjecting the container to three or more passes of the primary color halftone negatives, a composite picture is created. Throughout the entire operation precise alignment must be held so that the color dots fall adjacent each other.

Accordingly, it is an object of the present invention to provide a novel method for the printing of opaque glass enamels by the halftone process.

Another object of the present invention is to obtain an array of colors and hues heretofore not obtainable by the halftone process of printing on glass with opaque glass enamels.

A further object of this invention is to create a decorated glass article with the use of a plurality of primary colors deposited through a halftone screen.

Another object of the invention is to so vary the angles of the halftone dots so as to eliminate the moire effect.

An additional object of the present invention is to vary the percentage of the pigment in the opaque glass enamels so as to produce hues and colors not obtainable by mixing the pigments themselves.

It is another object of the present invention to produce colors approaching magenta red without the incorporation of gold into the glass enamel formulation.

GENERAL DESCRIPTION OF THE INVENTION

This invention relates to the decoration of containers and particularly to the decoration of containers such as glass bottles and glass drinking tumblers. The decorative process is accomplished at a high rate of speed and employs a series of halftone images on separate silk screens. The use of the halftone process makes possible a wide variety of colors that would be exceedingly difficult to obtain by any other process.

The use of organic printing on glassware is and can be accomplished by the halftone process, however, the end result does not have the degree of permanence as that which can be attained by the utilization of the more durable inorganic pigments. Certain halftone color combinations achieved with organic inks are not as easily attainable when inorganic pigments are used in what would appear to be an identical manner.

Therefore, in the present invention the percentage of the pigments utilized, the screen angles employed and the sequence of applying the colors become important when an original artwork is reproduced on the surface of glassware.

THE DRAWING

The FIGURE represents the exterior side view of a typical glass container such as for example a glass drinking tumbler. It is of course to be realized that the container so depicted could equally well be a glass bottle or the like. The container 10 has an axis of symmetry 11 which is also the axis of revolution of the glass article. The profile view of the glass article shows distinctly the concave portion 13 which can be considered as that portion of the sidewall falling between the points A and B of reference line 14.

The decorative design 15 is positioned on the sidewall so that it falls partially within the concave portion 13. The design consists of an optional base coat 16 which can be for example a matte white or other fairly light colored glass enamel. The flower portion 17 of the decoration can be of several colors and hues of red, yellow and organge. The stem and leaves 18 can exhibit several different shades of green and blue, while the flower receptacle 19 can have a brown color interdispersed with shades of purple. The three primary colors are utilized in dot form to produce the various shades of color to be found on the design. In addition, it is possible to highlight the artwork and enhance the appearance of the decoration by superposing a dark brown or black pigmented glass enamel on such areas such as border 20 and area 21 on the flower center and the central veins 22 of the leaves.

DETAILED DESCRIPTION OF THE INVENTION

Figure 1:
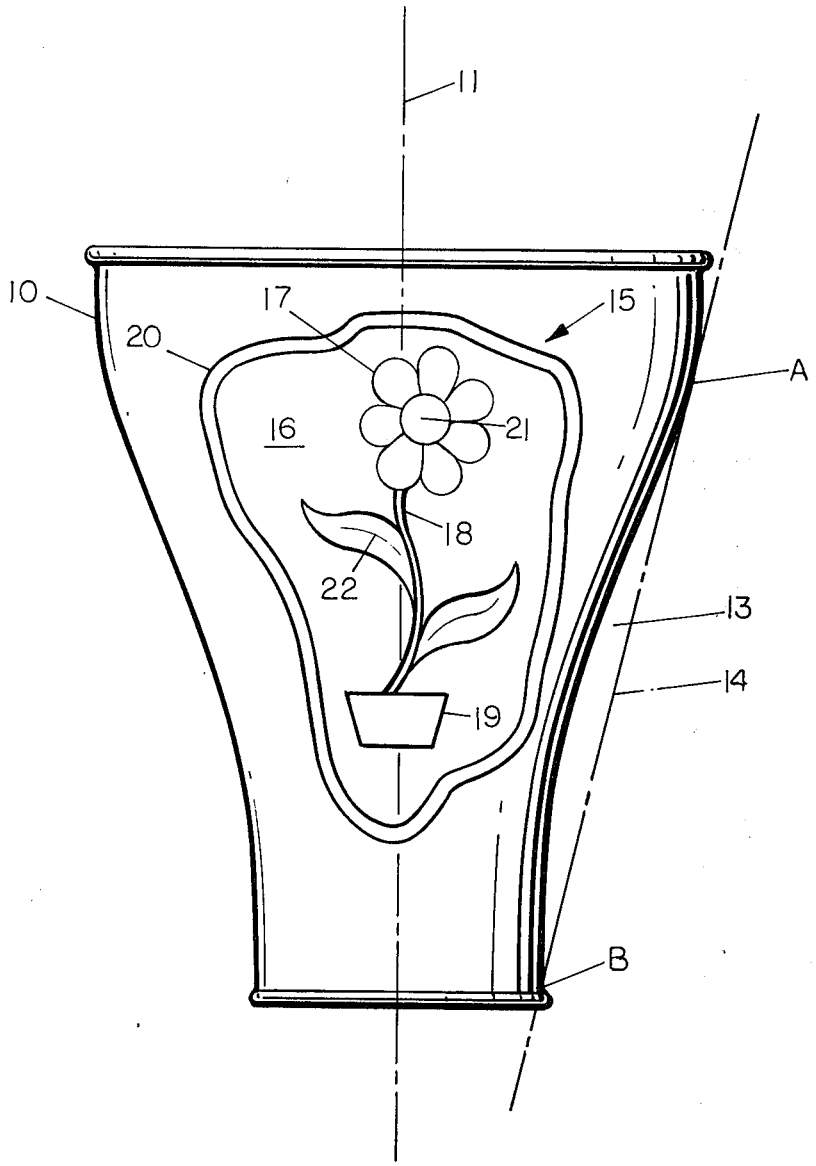

The success of the present invention involves several factors, thus necessitating a detailed description of the various techniques employed in practicing the invention.

A multicolored print suitable for decorating the sidewall of a glass bottle or drinking tumbler is chosen. The print is sized to the container sidewall by either enlarging or reducing it as desired. The color print is then color separated by scanning it with the aid of various filters to block out certain of the primary colors while retaining a shade of gray that represents, for example, the primary color red. In a similar manner, gray scale continuous tone negatives are made for the primary colors blue and yellow. The gray scale continuous tone negatives are then printed on photographic film sheet material or other suitable transparent film sheet material. The halftone image imposed upon the transparent sheet is known as a positive and is used in that manner.

The halftone positives are, as is well known in the art, comprised of a series of parallel rows of dots ranging from the middle tones where the positive exhibits dots 50% white and 50% black. The highlight tones are those areas where the so called black dots are at a minimum and the shadow tones are represented by the area where the so called white dots are at a minimum. The number of dots per inch can vary according to the particular work involved. It is common to utilize dot values of 60–80 dots per inch in the decoration of glassware.

The angle of the dots on a halftone positive becomes important when screen techniques and multicolors are employed. The angle assumed by the rows of dots will be taken herein as the angle subtended between the dot line and a horizontal line.

After the properly dot oriented halftone film positives are created, one each for the primary colors, the image the halftone positives carry is transferred to a silk screen.

Throughout the specification reference is made to a silk screen since silk cloth was the first screen material to see widespread use in the decorating art. The term silk screen can also mean any one of the synthetic materials such as nylon or even fine wire mesh. While wire mesh screen has certain disadvantages, it excels in strength and in electrical conductivity.

The silk screen, a wire mesh in this particular instance, is prepared in the following manner. The material is unrolled and checked for flaws which could be detrimental to the deposition of an even coat of pigment through the interstices of the screen. The screen is placed in a rectangular stretch frame to place the individual threads or wires in tension. While the warp and weft directions of the fabric do not play a very important part in the orientation of the screen, a better balanced screen is produced if the warp is aligned along the length of the screen, since under ordinary weaving techniques the warp threads have less linear variation than do the weft threads. The frames, whether they be wood or metal, are positioned on the stretched screen and fastened thereto by staples or clamp bars. The screen material exterior of the hold down points is severed, thus releasing the frame and its taunt screen.

The newly created screen is then subjected to a degreasing step wherein it is washed with water and a degreasing agent such as soap to release any oil that may remain on the screen from its original manufacture. The excess degreasing solution is removed by means of compressed air that in itself has been decontaminated by passing it through a moisture and oil trap.

The dry screens are then coated with a photosensitive emulsion, such as for example a product sold under the name of Azocol and manufactured by the Azoplate Division of American Hoechst Corporation. The rather low viscosity emulsion is applied directly on the screen by means of a screen applicator. Both sides of the screen are coated with emulsion to insure that all voids in and around the screen mesh are filled. The emulsion coated screen is then set aside in a nonlight sensitive environment to dry.

After the emulsion has dried, the screen is placed frame side down and one of the color separation positives is positioned with its film positive side next to the emulsion on the coated screen. Temporary holding means such as tape is used to hold the halftone positive in orientation with respect to the direction of the individual wires of the screen. The screen and the halftone positive are then positioned on a light exposure table with the positive next to the glass. The screen or a plurality of screens are held against the glass surface of the light table by means of a clamping arrangement or vacuum sheet.

The screen which was coated directly on the mesh with a photo emulsion was exposed to a point source actinic light such as a carbon arc or xenon tube. Both light sources produce a light with a relatively high ultra violet content, thus facilitating the fixing of the photo emulsion at the desired locations on the screen mesh. The error in the masked areas of the screen is minimized because of the close direct contact between the positive and the sensitized mesh coating. The close contact between the positive and the mesh results in multidirectional light rays having little effect upon the image definition.

After a sufficient time period has passed and the emulsion is thoroughly exposed, the screen is washed in water until the unexposed areas, equivalent to the film positive, are removed. The residual unexposed emulsion and the wash water are blown out of the screen interstices. The screen is then ready for use.

Not only is one screen produced, but several screens are produced, one for each one of the halftone separations that were made of the original artwork.

The alignment of each respective halftone positive is maintained on each of the screens to insure a close registration of the color dots when actual printing is undertaken.

In the actual utilization of the screens with the halftone images superposed thereon, a bottle or glass tumbler is held in a chuck mechanism that permits rotation of the tumbler or bottle. The screen is placed horizontally above the glass object and tangentially in contact therewith. As the glass object is rotated, a squeegee forces glass enamel through the screen and deposits an amount of pigment as dictated by the original color separation performed on the original artwork. If three screens are utilized, one representing each of the primary colors red, blue and yellow, the end result will be a color reproduction that has the appearance of the original artwork. Because of the inherent transparency of glass, color reproductions placed thereon ofter lack brightness. To enhance brightness and better simulate the original artwork, a white or other light colored background is sometimes utilized as a first coat.

DETAILED DESCRIPTION OF THE INVENTION

As has heretofore been commented upon, the separation of halftone positives from an original artwork can be utilized to create full color reproductions on flat surfaces utilizing organic dies. The same percentages of pigmentation do not apply when the same colors are to be created on a glass surface utilizing inorganic pigments either transparent or opaque.

In the decoration of glassware organic inks can be used, however, their durability is not great in that they are easily abraded and scratched. There is no chemical uniting with the surface of the glass when organic inks are utilized in decorating.

Glass color enamels provide a greater degree of permanence in the decoration of glassware. There are essentially two primary types of glass enamels that are important in creating lasting decorations on the surface of glass. The first glass enamel is known as a transparent enamel and produces color effects on glass similar to the effect to be found on stained glass windows. The transparent enamels are superior to organic decoration materials, however, they do not withstand for long the highly caustic dishwasher soaps employed in automatic dishwashers of today.

The second type of glass enamel is known as opaque and provides the highest degree of protection against erosion caused by modern glass cleansing solutions. The opaque enamels transmit far less light because of the color pigments and stabilizing additives that are incorporated into the enamel composition.

Below is set forth a typical composition range for a transparent enamel.

PbO: 60–70 percent
$SiO_2$: 15–20 percent
$B_2O_3$: 8–14 percent
$Al_2O_3$: 1–5 percent The above set forth transparent enamel lacks chemical durability against certain acids and alkaline substances, consequently, certain stabilizers are incorporated into the transparent enamel formula to enhance chemical durability. Typical stabilizers and their percentages are listed below.

$TiO_2$: 1.0–5.0 percent
$ZrO_2$: 1.0–5.0 percent
CdO: 1.0–5.0 percent
$Na_2O$: 0.5–1.0 percent
$K_2O$: 0.5–1.0 percent In utilizing an opaque enamel as set forth above, it is important to maintain a good ratio between the dot-count of the halftone positive and the thread-count of the screen. It has been found that a thread-count to dot-count should be in the range of 4:1. For example, a dot-count of 75 lines per inch and a thread-count in the range of 300–350 produced desirable results. When the screen mesh wire diameter is large in comparison to the highlight dot, openings will be covered by the large size of the individual screen threads, likewise, the reverse shadow dots will not be effective.

In addition to the importance of a reasonably high ratio of thread-count to dot-count, it is important to minimize the moire effect which can from time to time be observed and which is quite vexatious, particularly when it occurs in an area such as on the face of a printed character. The moire or interference pattern effect is produced by a coincidence between the threads of the screen and the dot spacing which was superposed on the screen from the film positive. Therefore, it is important to locate the most favorable angle of the dot lines with respect to the warp and weft of the screen. It has been proposed that there always be 30° between the halftone screen angles. We have found that 30° may be a general rule of thumb, but that not always are the best results obtained and the moire effect eliminated. Below are the angles which we have found to be most effective in eliminating the adverse effects of the moire pattern for a dot-count of 75 dots per inch when used in conjunction with a 325 mesh screen.

Yellow: 56°
Red: 36°
Blue: 69°

When the above primary colors are utilized at the prescribed angles, it is common to first print the yellow color with full saturation. The yellow can be printed by itself or it can overlay a coat of white enamel which enhances and brightens the remaining colors. If the yellow color is printed too light, even though subsequently printed colors are held on the light side, the overall effect will have a washed out appearance and will lack the desired brilliance.

Set forth below are some examples that outline the steps followed in arriving at the present invention.

EXAMPLE 1

A flat glass plate was mounted for reception of the selected pigments. The pigments were in the form of a cold paste dispersed in a cold oil number 662 manufactured by Drakenfeld Colors, Coatings and Speciality Products, a division of Hercules, Inc. While the exact compositions of the various glass enamels are proprietary with the above listed company, the basic opaque enamel is believed to be quite similar to that which has been set forth supra. The pigments are believed to be as follows; yellow-cadmium sulfide, blue-cobalt oxide, red-cadmium selenium sulfide. All of the enamels discussed herein are specific products of the Drakenfeld Division of Hercules, Inc.

A CT 7800 white, Drakenfeld opaque enamel was deposited through a 230 mesh screen to form a uniform white coat on the glass surface. The coated glass plate was dried in an oven, then a BL-539 yellow with a pigment content of 13.04 wt. percent was deposited through a halftone 325 mesh screen and also dried. A BL-540 blue with a pigment content of 13.04 wt. percent was overlaid on top of the yellow, then followed by a BL-541 red with a pigment content of 4.76 wt. percent. After drying, the composite was fired for 10 minutes at approximately 1100° F. The results indicated no green with blue over yellow; instead a muddy dark color resulted. The red selected appeared washed out on bare glass and was slightly better on a white background. Acceptable orange derived from red over yellow resulted; the purple hues looked promising.

EXAMPLE 2

An original print containing a flower arrangement was color separated to produce the three primary yellow, blue and red 60 dot per inch halftone positives. The yellow dots were at an angle of 90° with respect to the warp of the 325 mesh screen. The blue and red dots were aligned on their respective halftone positives at 75° and 105°, respectively. An opaque BL-539 yellow enamel was used with a pigment content of 13.04 wt. percent. A transparent BL-599 blue enamel with a pigment content of 8.6 wt. percent was used along with a BL-541 red having a pigment content of 4.76 wt. percent. All of the enamels were of the hot melt variety with yellow being deposited first, blue second and red third. The results indicated muddy orange areas. It appeared that the amount of pigment in the red and blue could be reduced considerably. The angles selected for the printing of the dots resulted in a bad moire effect.

EXAMPLE 3

A white 20-519 matte glass enamel was printed on the surface of a glass tumbler through a 280 mesh screen for complete coverage. A 23-2281 yellow enamel with a pigment content of 13.04 wt. percent was deposited through a halftone screen at an angle of 110° with respect to the screen warp. A 27-3155 blue enamel with a pigment content of 4.76 wt. percent was deposited through a halftone screen at an angle of 80°. A 21-1518 red enamel was next deposited through a halftone screen oriented at 50° with respect to the screen warp. All of the above printing was at 75 dots per inch. The resulting colors were brighter than those previously attained, however, the moire effect still persisted in the red over yellow areas. The moire effect of blue over yellow was acceptable.

EXAMPLE 4

The previous example was repeated, however, the angles of the halftone positives were changed as follows: yellow 56°, red 36° and blue 69°. The moire effect was not evident in the resulting prints.

EXAMPLE 5

In order to fully overcome the moire effect which was evident when 75 dots per inch halftone positives were used with a 325 mesh screen, tests were conducted to determine the optimum dot to mesh angles. Tests revealed the red halftone positive exhibited moire effect at an angle of 30° with respect to the screen filaments. Over the range of 33°–39° the moire effect was not observable. At 43° the moire effect was again visible. Tests were conducted on the yellow halftone positive. The moire effect was objectionable at 51° but was acceptable over the range of 53°–59°. At 60° the moire effect once again appeared. The tests associated with the blue halftone positive showed that there was a moire effect at 66° and that its effect diminished to the acceptable level over the range of 67°–70°. At 71° the moire effect had once again increased to the objectionable level.

Through the use of the amount of pigments as expressed in the above set forth examples, it has been possible to create hues of purple that have not been seen elsewhere in glassware decorated by the halftone process utilizing opaque glass enamels. Prior to the present invention, magenta reds were obtained by the addition of gold to the glass enamel formula. The present invention has revealed that it is possible to obtain color and hues approaching the colors heretofore obtainable only by the addition of the element gold as a pigment constitutent. A more complete color spectra is now available for the decoration of glassware without relying upon gold which has become increasingly expensive.

PRODUCTION SETUP

The present invention can be practiced by any machine that has the capability of precisely holding the glass article, rotating it through a specified arcuate extent and returning to the original starting point.

One method of decorating articles such as bottles or glass tumblers relies upon the glass article being chucked for rotation below a horizontally aligned mesh screen. The screen is adjusted so that the bottle rotates beneath the screen with the squeegee remaining on top of the screen yet in close proximity to the bottle. Since it is desirable to have the decorating enamel set or harden as soon as possible, hot melt wax or resin type vehicles are utilized. The enamels are kept in a fluid state by elevated temperatures maintained by passing a current through the metallic screen. The glass articles are decorated by means of a first layer which is generally the background solid color. The next color applied over the background color is the yellow halftone. Care is then taken to adjust the next halftone blue enamel screen so that the dots thereon are in close register with the previously deposited yellow dots. Likewise, precise alignment is required with the third primary red color screen so that the red dots fall in close proximity to the yellow and blue halftone dots. This alignment is part of the machine setup procedure regardless of whether the glassware is all printed with one color, then recycled through the same single stage decorating machine, or whether the decorating is accomplished on a multistage machine where the glassware need be unloaded from a conveyor only one time before the decorative sequence is completed.

The decorated glassware is then fed through an annealing lehr where the temperature is raised to fire the deposited frit enamels and reduce them to the molten state so that they adhere to the surface of the article being decorated.

What is claimed is:

1. The method of color decorating an axially concentric glass article including the steps of;

(a) selecting a colored design or decoration, (b) separating the colored design into component continuous tone prints, each representing a primary color, (c) creating halftone positives from the continuous tone prints for each primary color, (d) transferring the image of each halftone positive to an emulsion coated mesh screen with the angle of the halftone dot lines all lying within the range of 32 to 70 degrees with respect to the filament direction of the mesh screen, (e) depositing a first coat of low contrast color through its halftone screen onto the surface of the glass, (f) applying the remaining dominant primary colors one at a time through their respective halftone screens to the surface of the glass while maintaining close registration with said first deposited coat, (g) firing the decorated article to adhere the decorative material to the surface of the glass.

2. The method of color decorating an axially concentric glass article as claimed in claim 1 wherein the second primary color to be applied is blue and the third primary color is red.

3. The method of color decorating a generally cylindrical glass article as claimed in claim 1 wherein the second primary color to be applied is red and the third primary color is blue.

4. The method of color decorating a generally cylindrical glass article as claimed in claim 1 wherein the angle of the halftone dot lines with respect to the screen filament on the first to be deposited primary color is intermediate the angles of the halftone dot lines of the subsequently deposited primary colors.

5. The method as claimed in claim 4 wherein the minimum halftone dot line angle is associated with the primary color red, the intermediate halftone dot line angle is associated with the primary color yellow and the greatest halftone dot line angle is associated with the primary color blue.

6. The method as claimed in claim 4 wherein the angle associated with red is in the range of 33°–39°, the angle associated with yellow is in the range of 53°–59° and the angle associated with blue is in the range of 67°–70°.

* * * * *